US009314896B2

(12) United States Patent
Radif

(10) Patent No.: US 9,314,896 B2
(45) Date of Patent: Apr. 19, 2016

(54) POWER TOOL

(71) Applicant: ATLAS COPCO INDUSTRIAL TECHNIQUE AB, Stockholm (SE)

(72) Inventor: Nabil Khalil Radif, Nacka (SE)

(73) Assignee: ATLAS COPCO INDUSTRIAL TECHNIQUE AB, Stockholm (SE)

( * ) Notice: Subject to any disclaimer, the term of this patent is extended or adjusted under 35 U.S.C. 154(b) by 0 days.

(21) Appl. No.: 14/411,785

(22) PCT Filed: Jun. 11, 2013

(86) PCT No.: PCT/EP2013/061947
§ 371 (c)(1),
(2) Date: Dec. 29, 2014

(87) PCT Pub. No.: WO2014/005800
PCT Pub. Date: Jan. 9, 2014

(65) Prior Publication Data

US 2015/0158138 A1 Jun. 11, 2015

(30) Foreign Application Priority Data

Jul. 3, 2012 (SE) ..... 1250756

(51) Int. Cl.
*B24B 23/02* (2006.01)
*B25F 5/00* (2006.01)
*B24B 47/10* (2006.01)

(52) U.S. Cl.
CPC ..... *B24B 23/026* (2013.01); *B24B 47/10* (2013.01); *B25F 5/001* (2013.01)

(58) Field of Classification Search
CPC .... B24B 23/026; B24B 23/022; B24B 23/02; B24B 23/028; B24B 47/10; B25F 5/001
See application file for complete search history.

(56) References Cited

U.S. PATENT DOCUMENTS 5,679,066 A * 10/1997 Butz ..... B24B 23/03 451/344
5,839,950 A * 11/1998 Johansson Edling . B24B 23/028 451/344

(Continued)

FOREIGN PATENT DOCUMENTS

| | | | |
|---|---|---|---|
| EP | 0261374 | A1 | 3/1988 |
| EP | 1327497 | A2 | 7/2003 |
| JP | 2008271791 | A | 11/2008 |

OTHER PUBLICATIONS

International Search Report (ISR) and International Preliminary Report on Patentability (IPRP) issued in International Application No. PCT/EP2013/061947.

*Primary Examiner* — Dung Van Nguyen
(74) *Attorney, Agent, or Firm* — Holtz, Holtz & Volek PC

(57) ABSTRACT

A hand held power tool includes: a motor room housing a motor that drives an output shaft; a bevel gear including interconnected pinion and crown gears, wherein the pinion gear is connected to a pinion shaft drivingly connected to the output shaft and the crown gear is drivingly connected to a tool holding shaft; a gear housing that delimits a fluid tight gear space around the bevel gear; a bearing, around the pinion shaft and close to the pinion gear, which delimits a confined space around the pinion shaft and within the gear space; and a fluid tight axial sealing, around the pinion shaft inside the confined space of the gear space, which seals off the gear space from the motor room. At least one fluid conveying opening is arranged to put the confined space of the gear space in fluid contact with the rest of the gear space.

12 Claims, 2 Drawing Sheets

(56) References Cited

U.S. PATENT DOCUMENTS

| | | | | |
|---|---|---|---|---|
| 6,464,572 | B2 * | 10/2002 | Jansson | B24B 23/02 451/295 |
| 6,810,970 | B1 | 11/2004 | Kraenzler et al. | |
| 9,079,290 | B2 * | 7/2015 | Esenwein | B24B 23/028 |
| 2003/0190877 | A1 | 10/2003 | Gallagher et al. | |
| 2004/0069513 | A1 * | 4/2004 | Wolf | B24B 23/022 173/216 |
| 2012/0157257 | A1 * | 6/2012 | Hirabayashi | B24B 23/028 475/159 |
| 2012/0247247 | A1 * | 10/2012 | Matsuno | B24B 23/028 74/417 |
| 2012/0252328 | A1 * | 10/2012 | Muto | B24B 23/022 451/453 |

* cited by examiner

POWER TOOL

The invention relates to a power tool such as a grinder. Specifically, the invention relates to a power tool with an improved fluid sealing arrangement between a gear space and a motor room.

BACKGROUND

A conventional power tool, such as e.g. a grinder, comprises a bevel gear that is provided to redirect the rotational movement from a pinion shaft rotating around a first axis to an output shaft rotating around a second axis that is substantially perpendicular to the first axis.

The bevel gear is continuously in need of lubrication. In the type of power tool to which the invention relates this may be solved in that a lubrication fluid is arranged in a fluid tight gear space that surrounds the bevel gear. In order to prevent that the lubrication fluid leaks out from the gear space, the gear space is sealed off. Hence, the gear space is a fluid tight space that is delimited by a gear housing. The gear housing is normally formed of several parts and inter alia includes two sealings, one axial sealing around the pinion shaft and one radial sealing around the output shaft. Further, both the output shaft and the pinion shaft are supported by bearings, which preferably are located as close as possible to the bevel gear.

A problem that arises in conventional power tools of this type is that especially the axial sealing around the pinion shaft is degenerated over time, such that lubrication fluid may eventually leak into the motor room and/or pass out to the area known as the reception area, e.g. the area immediately surrounding the power tool and the operator. The sealing surrounding the pinion shaft is specifically crucial as the pinion shaft rotates about five to ten times faster than the output shaft, depending on the gear ratio of the bevel gear.

Hence, there is a need for a power tool in which the life time of the sealing around the pinion shaft is prolonged and in which the overall reliability of the power tool is ameliorated.

SUMMARY OF THE INVENTION

An object of the invention is to provide a power tool with an improved reliability. This object is achieved by the invention according to the independent claims.

According to a first aspect the invention relates to a hand held power tool, which power tool comprises:

- a motor room that houses a motor that drives an output shaft;
- a bevel gear comprising an interconnected crown gear and pinion gear, wherein the pinion gear is connected to a pinion shaft that is drivingly connected to the output shaft and the crown gear is drivingly connected to a tool holding shaft;
- a gear housing that delimits a fluid tight gear space around the bevel gear;
- a bearing arranged around the pinion shaft, close to the pinion gear, which bearing delimits a confined space around the pinion shaft and within the gear space; and
- a fluid tight axial sealing arranged around the pinion shaft inside the confined space of the gear space, which sealing seals off the gear space from the motor room, wherein at least one fluid conveying opening is arranged to put the confined space of the gear space in fluid contact with the rest of the gear space.

An advantage of the invention with respect to a conventional power tool of the prior art is that the sealing is continuously provided with the lubrication fluid that surrounds the bevel gear and that is present in the fluid tight housing that delimits the gear space around the bevel gear. The provision of lubrication to the sealing prevents burning and maintains the function of the sealing throughout its operational lifetime. If there was no opening to connect the gear space to the confined space between the fluid tight axial sealing and the bearing, the axial sealing around the pinion shaft may eventually dry out such that its function would slowly degrade.

An alternative to the inventive solution would be to arrange the bearing that support the pinion shaft inside of the sealing 20. This is however an inferior solution with regard to the mounting of the pinion shaft. Namely, for an optimal distribution of forces the pinion shaft should be journalled as close as possible to the pinion gear. With the inventive solution, the bearing may be located as close as possible to the pinion gear without negatively affecting the function of the sealing.

In a specific embodiment of the invention the bearing is supported by a hollow support member that is arranged outside the pinion shaft, wherein the confined space of the gear space is axially delimited by the bearing on one side and by the fluid tight axial sealing on the other side, and radially by the hollow support member.

In one embodiment of the invention the at least one fluid conveying opening is arranged as at least one track between the bearing and the hollow support member.

In another embodiment of the invention the at least one fluid conveying opening may be arranged as at least one channel through the hollow support member.

In yet another embodiment of the invention the bearing is supported by the gear housing, wherein the confined space of the gear space is axially delimited by the bearing on one side and by the fluid tight axial sealing on the other side, and radially by the hollow support member, and wherein the at least one fluid conveying opening is arranged as at least one track along the interface between the bearing and the gear housing.

The hand held power tool may preferably be a grinder, and specifically it may be a pneumatic grinder.

Preferred embodiments and other advantages of the invention will be apparent from the detailed description.

SHORT DESCRIPTION OF THE DRAWINGS

In the following detailed description reference is made to the accompanying drawings, of which:

DETAILED DESCRIPTION OF ONE EMBODIMENT OF THE INVENTION

Figure 1:
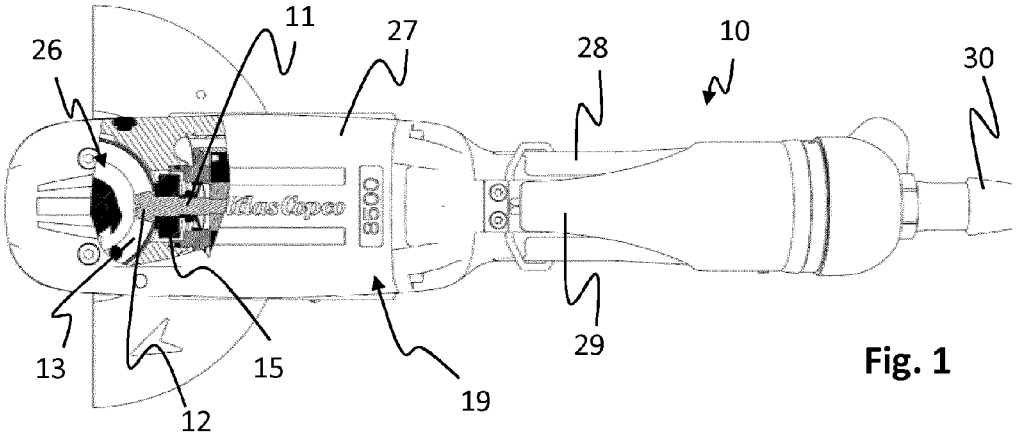
FIG. 1 shows a power tool according to an embodiment of the invention from above, in which a gear space is shown in a sectional view.

In FIG. 1 a power tool 10 according to a specific embodiment of the invention is shown. The power tool 10 comprises a motor room 19 and a gear space 26, which are housed in a common outer housing 27. Further the power tool 10 comprises a handle 28, on which a lever 29 is arranged for controlling the air supply to a motor arranged inside the motor room 19. The handle is connected to an air supply hose 30 for supply of pressurized air to the motor.

As is visible in the cut out section of FIG. 1 the gear space 26 includes a bevel gear 12, 13, in which a pinion shaft 11 is connected via a pinion gear 12 to a crown gear 13.

Figure 2:
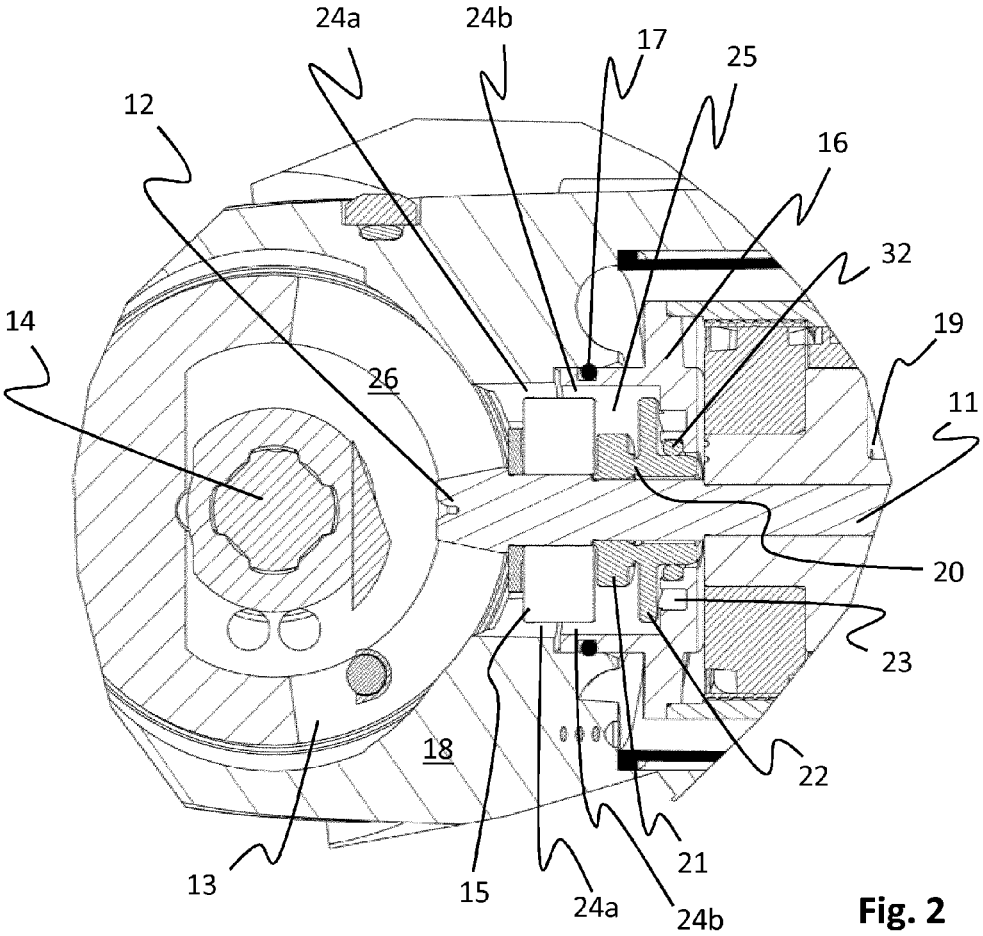
FIG. 2 shows a detailed sectional view of the gear space shown in FIG. 1.

FIG. 2 shows a close up of the part of the power tool 10 to which the invention relates. A pinion shaft 11 is arranged to transmit the motor output from the motor inside a motor room 19 to the bevel gear 12, 13, which is located inside a gear housing 18 that delimits the gear space 26. The bevel gear comprises a pinion gear 12, which constitutes the end part of the pinion shaft 11, and a crown gear 13, which is connected to an output shaft 14. The bevel gear transmits the rotation of the pinion shaft 11 to the output shaft 14, which is arranged orthogonally with respect to the pinion shaft 11. The bevel gear normally gears down the rotation of the pinion shaft 11 about five to ten times depending on the gear ratio. Hence, the output shaft normally rotates at a lower speed, but at a correspondingly higher torque level.

A bearing 15 is arranged around the pinion shaft 11. In the shown embodiment the bearing 15 is kept at place by means of the gear housing 18 and a hollow support member 16. The hollow support member 16 is in the shown embodiment arranged to provide a fluid tight connection between the gear housing 18 and the motor room 19. Namely, a lubrication fluid is arranged inside the gear space 26 defined inter alia by the gear housing 18, which fluid must not be allowed into the motor room 19. Therefore, the connection between the gear housing 18 and the hollow support member 16 includes a first static sealing 17, e.g. in the form of an O-ring.

The fluid tight connection between the hollow support member 16 and the motor room 19 is more complicated, due to the fact that this connection involves a moving part, i.e. the pinion shaft 11. In fact, in one embodiment of the invention the pinion shaft 11 is arranged to rotate at about 65,000 rpm, and the output shaft 14 is arranged to rotate at about 8,500 rpm. A rotation of that magnitude puts high demands on the fluid tightening used.

In the shown embodiment of the invention the fluid tightening consists of an axial sealing 20 that comprises a first sealing part 21 that is fixedly attached the pinion shaft 11, so as to rotate with the pinion shaft 11. A second sealing part 22 is arranged to seal against the first sealing part 21. The first and second sealing parts 21, 22 comprises mutually opposed sealing surfaces of high precision that are arranged to rotate with respect to each other.

The second sealing part 22 is provided with a spring (not shown) that is arranged in a spring seat 23 in the hollow support member 16 and acts towards the first sealing part 21. Further, a second static sealing 32, e.g. in the form of an O-ring, is arranged to seal between the second sealing part 22 and the hollow support member 16.

In this sealing arrangement, the crucial sealing is the sealing between the first and second sealing parts 21, 22. This is due to the very high rotational speed of the pinion shaft 11 and the first sealing part 21 with respect to the radially fixed second sealing part 22. The axial sealing is completed by means of a film of lubrication fluid that is formed between the first and second sealing parts 21, 22 from the lubrication fluid provided inside the gear housing 18. The lubrication fluid is necessary for the well function of the axial sealing 20, and functions both to lower the friction and to cool the sealing. If there is not enough lubrication fluid the sealing may dry out and burn such that the sealing function will degrade and eventually be lost.

As indicated above, the bearing 15 is held at place by the gear housing 18 and the hollow support member 16. The hollow support member 16 delimits a confined space 25 within the gear space 26 that is defined by the gear housing 18. This confined space 25 is axially delimited by the bearing 15 on one side and by the fluid tight axial sealing 20 on the other side, and radially by the hollow support member 16.

The invention is related to the provision of lubrication fluid to the axial sealing 20. In order to make sure that lubrication fluid will be provided to the axial sealing 20, at least one opening 24*a* and 24*b* is provided between the gear space 26 and the confined space 25 surrounding the axial sealing 20. In the shown embodiment four such openings 24*a*, 24*b* are arranged 90 degrees apart around the bearing 15, whereof two are visible in FIG. 2; one above and one below the bearing 15. The openings 24*a*, 24*b* consist of channels in the interface between the bearing 15 and the hollow support member 16 and in the interface between the bearing 15 and the gear housing 18. Hence, there is a first opening 24*a* between the bearing 15 and the gear housing 18, and a second interconnected opening 24*b* between the bearing 15 and the hollow support member 16. These two interconnected openings 24*a* and 24*b* together form one continuous opening, in the form of a channel. Specifically, the channels are formed as axial recesses along the interior surface of the hollow support member 16 and the gear housing 18.

These openings 24*a*, 24*b* solve two problems that were apparent in the prior art. Firstly, the openings 24*a*, 24*b* guarantees that there is a continuous flow of lubrication fluid to the axial sealing 20, such that the friction between the first and second sealing parts 21, 22 is kept as low as possible and such that the sealing 20 is continuously cooled. Secondly, the openings 24*a*, 24*b* provides for the possibility to even out the pressure between the confined space 25 around the axial sealing and the rest of the gear space 26.

In the prior art, the lubrication fluid could only travel from the confined space 25 around the axial sealing to the rest of the gear space 26 and vice versa through the bearing 15. This has proven to not always be sufficient in order to provide necessary lubrication and cooling. Further, as a consequence of the friction in the axial sealing the temperature, and thus the pressure, may increase in the confined space around the axial sealing. This increased pressure gives rise to a force that acts on the second sealing part 22, which may cause the second sealing part 22 to move away from contact with the first sealing part 21, such that a fluid emitting gap may be formed there between. When such a gap is formed an undesired leakage into the motor room 19 may occur.

Hence, the openings 24*a*, 24*b* according to the invention will prevent leakage. It is worth noting that these openings may be arranged in other ways. For instance they may be achieved as through holes through the hollow support member 16. In another not shown embodiment the hollow support member 16 may be dispensed with, wherein the gear housing may be sealed directly to the motor room housing. In such an embodiment the bearing 15 may also be held at place by the gear housing 18 and/or the motor room housing, wherein the openings may be achieved as channels between the connection of the bearing 15 to the gear housing and/or the motor room housing.

Figure 3:
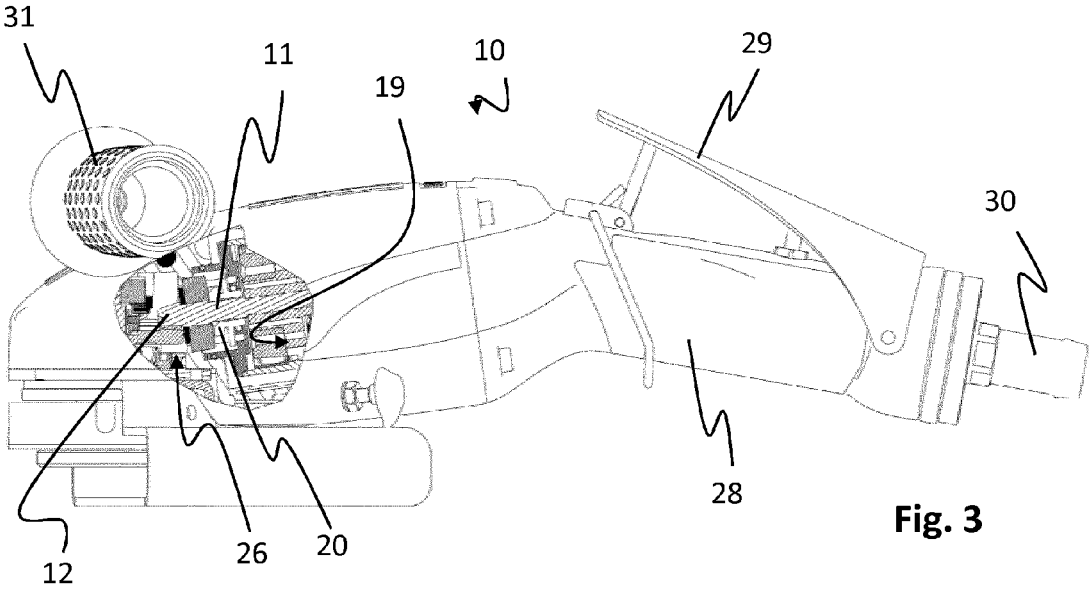
FIG. 3 shows a side view of a power tool according to an embodiment of the invention, in which a gear space is shown in a sectional view.

In FIG. 3 a side view of a power tool 10 according to an embodiment of the invention is shown. As is visible the power tool includes a handle 28 with a lever 29 arranged to control the air supply. An air supply hose 30 is connected to the back end of the handle 28. Further, a support handle 31 is arranged on the left front end of the power tool 10.

Figure 4:
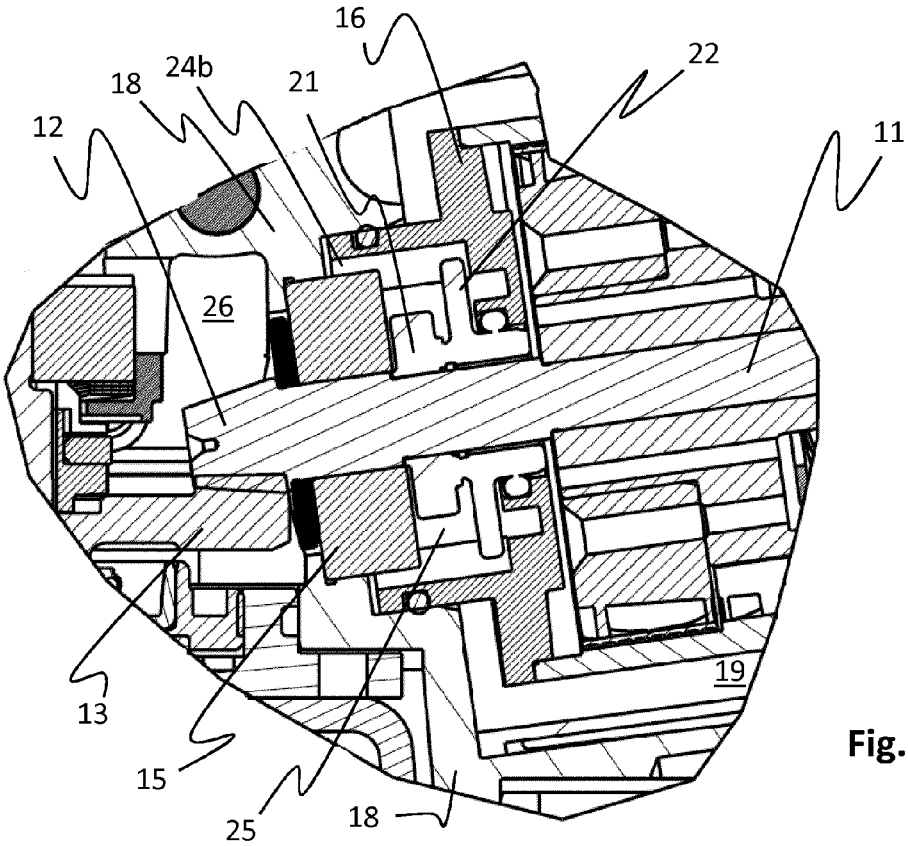
FIG. 4 shows a detailed sectional view of the gear space s shown in FIG. 3.

The gear space 26, which is shown in a sectional view, is shown in detail in FIG. 4. In this view it is apparent that the gear housing 18 is in contact with the bearing 15. This of course depends on where the section is taken. As described above the shown embodiment includes four openings 24*a* and

24*b*, which are located about 90 degrees apart around the bearing 15, and which are provided as tracks between both the gear housing 18 and the bearing 15 and between the hollow support member 16 and the bearing 15.

Above, the invention has been described with reference to specific embodiments. The invention is however not limited to either of these embodiments. Instead the scope of the invention is defined by the following claims.

The invention claimed is:

1. A hand held power tool comprises:

a motor room that houses a motor that drives a motor output shaft;

a bevel gear comprising an interconnected crown gear and pinion gear, wherein the pinion gear is connected to a pinion shaft that is drivingly connected to the motor output shaft and the crown gear is drivingly connected to a tool holding shaft;

a gear housing that at least partly delimits a fluid tight gear space around the bevel gear;

a bearing, arranged around the pinion shaft and close to the pinion gear, which delimits a confined space around the pinion shaft and within the gear space; and a fluid tight axial sealing, arranged around the pinion shaft inside the confined space of the gear space, which seals off the gear space from the motor room, wherein at least one fluid conveying opening is arranged to put the confined space of the gear space in fluid contact with the rest of the gear space, wherein the bearing is supported by a hollow support member that is arranged outside the pinion shaft, and wherein the confined space of the gear space is axially delimited by the bearing on one side and by the fluid tight axial sealing on an other side further away from the bevel gear, and radially by the hollow support member.

2. The hand held power tool according to claim 1, wherein the at least one fluid conveying opening is arranged as at least one track between the bearing and the hollow support member.

3. The hand held power tool according to claim 2, wherein the hand held power tool is a grinder.

4. The hand held power tool according to claim 3, wherein the hand held power tool is a pneumatic grinder.

5. The hand held power tool according to claim 1, wherein the at least one fluid conveying opening is arranged as at least one channel through the hollow support member.

6. The hand held power tool according to claim 5, wherein the hand held power tool is a grinder.

7. The hand held power tool according to claim 6, wherein the hand held power tool is a pneumatic grinder.

8. The hand held power tool according to claim 1, wherein the bearing is supported by the gear housing, wherein the confined space of the gear space is axially delimited by the bearing on one side and by the fluid tight axial sealing on the other side, and wherein the at least one fluid conveying opening is arranged as at least one track along an interface between the bearing and the gear housing.

9. The hand held power tool according to claim 8, wherein the hand held power tool is a grinder.

10. The hand held power tool according to claim 9, wherein the hand held power tool is a pneumatic grinder.

11. The hand held power tool according to claim 1, wherein the hand held power tool is a grinder.

12. The hand held power tool according to claim 11, wherein the hand held power tool is a pneumatic grinder.

* * * * *